US009232882B2

(12) United States Patent
Choi et al.

(10) Patent No.: US 9,232,882 B2
(45) Date of Patent: Jan. 12, 2016

(54) DISHWASHER CONTROLLING METHOD WITH SELECTIVE WATER SUPPLY

(75) Inventors: Yong Jin Choi, Seoul (KR); Gap Su Shin, Seoul (KR); Byeong Hyeon Ju, Seoul (KR)

(73) Assignee: LG Electronics Inc., Seoul (KR)

( * ) Notice: Subject to any disclaimer, the term of this patent is extended or adjusted under 35 U.S.C. 154(b) by 1106 days.

(21) Appl. No.: 12/461,682

(22) Filed: Aug. 20, 2009

(65) Prior Publication Data

US 2010/0043828 A1 Feb. 25, 2010

(30) Foreign Application Priority Data

Aug. 21, 2008 (KR) ..... 10-2008-0081795

(51) Int. Cl.
*A47L 15/46* (2006.01)
*A47L 15/42* (2006.01)
*A47L 15/00* (2006.01)

(52) U.S. Cl.
CPC ..... *A47L 15/4234* (2013.01); *A47L 15/0005* (2013.01); *A47L 15/0015* (2013.01); *A47L 15/4221* (2013.01); *A47L 15/4225* (2013.01); *A47L 2401/12* (2013.01); *A47L 2401/20* (2013.01); *A47L 2501/03* (2013.01); *A47L 2601/04* (2013.01)

(58) Field of Classification Search
CPC ..... A47L 15/0005; A47L 15/4221; A47L 15/0015; A47L 15/4225; A47L 15/4234; A47L 2401/12; A47L 2401/20; A47L 2501/03; A47L 2601/04
USPC ..... 134/18, 25.2, 25.3, 30, 56 D, 58 D
See application file for complete search history.

(56) References Cited

U.S. PATENT DOCUMENTS 5,849,101 A * 12/1998 Edwards et al. ..... 134/18
8,518,188 B2 * 8/2013 Kim et al. ..... 134/25.2

(Continued)

FOREIGN PATENT DOCUMENTS

CA 2569288 5/2007
CN 1739442 3/2006

(Continued)

OTHER PUBLICATIONS

Machine translation of FR 2885790A1 to Bretaud.*

(Continued)

*Primary Examiner* — Douglas Lee
(74) *Attorney, Agent, or Firm* — Dentons US LLP

(57) ABSTRACT

Dishwashers and methods of control for operation of dishwashers are disclosed. The dishwasher may include an upper rack in an upper portion of a washing compartment configured to receive small dishes, such as a cup having a small washing load, and a lower rack in a lower portion of the washing compartment for placing large dishes, such as a dinner bowl having a large washing load. The operation of the dishwasher can include wash and rinse cycles having a plurality of sub-cycles. During the sub-cycles, the upper and lower racks can be selectively sprayed with water and steam can be supplied to the washing compartment based on configured conditions, such as a water temperature or operation time being reached. The operation of the dishwasher can reduce excessive washing of dishes having small washing loads and reduce power consumption of the dishwasher.

9 Claims, 3 Drawing Sheets

(56) References Cited

U.S. PATENT DOCUMENTS

| | | | | |
|---|---|---|---|---|
| 2005/0150529 | A1* | 7/2005 | Vanderroest et al. | 134/135 |
| 2005/0183746 | A1* | 8/2005 | McKee et al. | 134/25.2 |
| 2006/0037632 | A1* | 2/2006 | Nito et al. | 134/56 R |
| 2006/0054198 | A1 | 3/2006 | Choi | |
| 2006/0237044 | A1* | 10/2006 | Ferguson et al. | 134/34 |
| 2007/0068562 | A1* | 3/2007 | Wetzel et al. | 134/56 D |
| 2008/0190453 | A1 | 8/2008 | Hildenbrand | |

FOREIGN PATENT DOCUMENTS

| | | | |
|---|---|---|---|
| CN | 1931080 | | 3/2007 |
| CN | 101161186 | | 4/2008 |
| DE | 102007005834 | A1 | 8/2008 |
| EP | 1502535 | A2 | 2/2005 |
| FR | 2885790 | A1 * | 11/2006 |
| KR | 10-2006-0023409 | A | 3/2006 |
| KR | 10-0717475 | | 5/2007 |
| KR | 10-2008-0034549 | A | 4/2008 |
| WO | WO 2006129963 | A2 * | 12/2006 |
| WO | 2008-047981 | A1 | 4/2008 |

OTHER PUBLICATIONS

Machine translation of FR2885790A1 to Bretaud.*

* cited by examiner

DISHWASHER CONTROLLING METHOD WITH SELECTIVE WATER SUPPLY

CROSS REFERENCE TO RELATED APPLICATION

This application claims the benefit of Korean Patent Application No. 10-2008-0081795, filed on Aug. 21, 2008, which is hereby incorporated by reference as if fully set forth herein.

BACKGROUND OF THE DISCLOSURE

1. Field of the Disclosure

The present disclosure generally relates to dishwashers. In particular, the present disclosure relates to controls for a dishwasher that improves washing efficiency when dishes of varying washing loads are washed in a single washing compartment.

2. Discussion of the Related Art

A conventional dishwasher is a machine that sprays washing water on dishes placed in a tub to remove foreign matter, such as food scraps left on the dishes. Generally, the dishwasher is operated based on a washing cycle, which sprays washing water mixed with detergent in a tub that contains dishes, in order to remove foreign matter left on the dishes. The dishwasher may also heat the washing water to improve performance. Typically, after the washing cycle, a rinsing cycle occurs which sprays washing water that is not mixed with the detergent in the tub to remove any remaining foreign matter. After the washing cycle, a drying cycle takes place, which dries the dishes.

Typically, more than one spraying arm and at least one rack (for placing dishes that need to be washed) are provided in a single tub of the conventional dishwasher. For example, a dishwasher usually has an upper rack and a lower rack in a bi-level configuration within the tub. A number of holders are then provided on the upper rack, which hold small dishes, such as small cups with a small washing load, and a smaller number of holders are provided on the lower rack, which hold large dishes, such as dinner dishes or large bowls with a larger washing load. An upper spraying arm and a lower spraying arm are then provided which spray washing water at the upper and lower racks, respectively.

The operation of a conventional dishwasher, including the wash, rinse, and dry cycles are well-suited for cleaning larger dishes. Unfortunately, the conventional dishwasher is not well-suited for smaller dishes. For example, it may be inefficient to wash large dishes, which have a large washing load, with small dishes, which have a small washing load in the same dishwasher (and in particular, the same washing compartment).

SUMMARY OF THE DISCLOSURE

The present disclosure is generally related to a dishwasher that improves washing efficiency and methods of control and operation of the dishwasher. In some embodiments, dishes of different sizes, which have varying washing loads, can be washed in a single washing compartment of the dishwasher in a way that improves the washing efficiency over dishwashers of the prior art.

Advantages and features of the invention in part may become apparent in the description which follows and in part may become apparent to those having ordinary skill in the art upon examination of the following or may be learned from practice of the embodiments described herein. The advantages and features of the embodiments of the present invention may be realized and attained by the structures and processes described in the written description, the claims, and in the appended drawings.

To achieve these and other advantages and in accordance with the purpose of the present disclosure, as embodied and broadly described herein, a controlling method of a dishwasher comprising a washing compartment, a sump configured to contain water, a sump heater configured to heat the water, an upper and lower spraying arm configured to spray the water and an upper and lower rack is provided. The method may include performing a washing cycle comprising spraying steam to the washing compartment and spraying water to the upper rack and lower rack alternately by using the upper spraying arm and the lower spraying arm, the spraying of the steam and the spraying of the water being repeated alternated for a preset period, and rinsing by spraying the water toward the upper rack and the lower rack alternately.

The performing of the washing cycle may further include spraying the water using the lower spraying arm if the washing cycle reaches a preset first condition with the sump heater being on. The rinsing may be performed in a state of the sump heater being on. The rinsing may include spraying the water using the lower spraying arm if the rinsing cycle reaches a preset second condition. The preset first condition may be a first temperature of the water contained in the sump and the preset second condition may be a second temperature of the water contained in the sump. The first temperature may be between 67° C. and 73° C. The second temperature may be between 63° C. and 67° C.

The controlling method may further include at least one of draining the washing water or supplying new water before the rinsing, and drying after the rinsing. The supplying of the steam may be performed more than three times. In some embodiments, at least one of the first condition and the second condition may be an operation time of performing of the washing cycle or rinsing.

In an embodiment, a controlling method of a dishwasher comprising a washing compartment, a sump configured to contain water, an upper and lower spraying arm configured to spray the washing water, and an upper and lower rack is provided. The controlling method may include performing a washing cycle comprising supplying steam, spraying different volumes of water per unit time by using the upper and lower spraying arms alternately, and spraying water using the lower spraying arm for a preset period if a temperature of the washing water is over a preset first temperature, and draining the water used in the performing of the washing cycle and supplying new water. The supplying steam and the spraying water at the different volumes per unit time can be repeated alternately for a preset period. The water volume passed by the upper spraying arm per unit time may be smaller than the water volume passed by the lower spraying arm per unit time. The first temperature may be between 67° C. and 73° C.

The controlling method may further include rinsing by spraying the water at the upper rack and the lower rack alternately. The rinsing can include spraying water by using the upper and lower spraying arms alternately in a state of the sump heater being on, and spraying water by using the lower spraying arm if a temperature of the water used in the rinsing is over a preset second temperature. The second temperature may be between 63° C. and 67° C.

In some embodiments, a dishwasher may include a washing compartment comprising a bi-level rack configured to hold dishes; a plurality of spraying arms provided in the washing compartment with different heights, the spraying arms spraying water to the rack alternately. The dishwasher may also include a sump containing water used in washing or rinsing the dishes; a steam generator supplying steam at least one time between the alternate sprayings from the plurality of the spraying arms; and a pump supplying different volumes of water per unit time to different ones of the plurality of spraying arms. The number of revolutions per minute of a motor operating the pump may be changeable to supply the different volumes of the water per unit time to the plurality of the spraying arms.

According to embodiments of the present disclosure, washing efficiency of the dishwasher may be maximized when dishes with different washing loads are washed in a single washing compartment. In addition, one or more spraying arms of the dishwasher may be operated selectively based on washing loads. Advantageously, the time taken to wash the dishes may be reduced.

It is to be understood that both the foregoing general description and the following detailed description are exemplary and explanatory and should not be construed as limiting the scope of the claims.

BRIEF DESCRIPTION OF THE DRAWINGS

The accompanying drawings are included to provide a further understanding of the disclosure, and are incorporated herein and constitute a part of this application. The drawings together with the description serve to explain exemplary embodiments of the present disclosure. In the drawings.

DESCRIPTION OF THE EMBODIMENTS

Reference will now be made in detail to the specific embodiments of the present disclosure, examples of which are illustrated in the accompanying drawings. Wherever possible, the same reference numbers will be used throughout the drawings to refer to the same or like parts.

Figure 1:
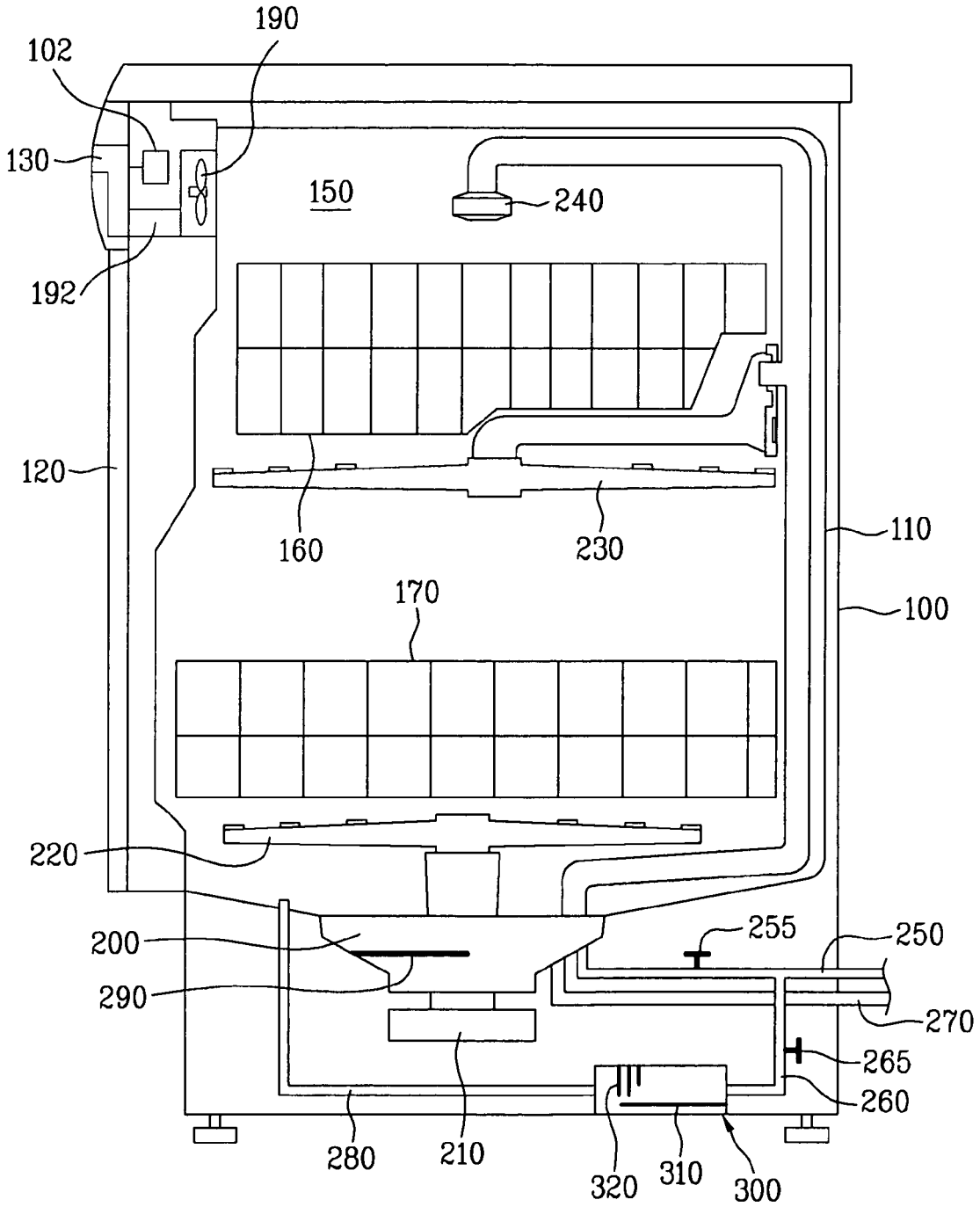
FIG. 1 illustrates a sectional view of a dishwasher and controls, according to an embodiment of the invention.

FIG. 1 depicts a sectional view of a dishwasher and controls, according to an embodiment of the invention. The dishwasher can include a case 100, which defines an exterior appearance, a door 120 for opening and closing the case 100, and a control panel 130 mounted on the case 100 or door 120 for operating the dishwasher. The case 100 may include a washing compartment 150 having a tub 110. Dishes can be placed in the washing compartment 150.

In an embodiment, a sump 200 can be positioned under the tub 110, which holds washing water. A pump 210 and a filter (not shown) can be provided in the sump 200. The pump 210 can pump the washing water held in the sump 200. The filter can advantageously filter contaminated water. In addition, a sump heater 290 may be provided in the sump 200 to heat water inside the sump 200.

With continued reference to FIG. 1, a first water supply pipe 250 and a water drain pipe 270 can be connected with the sump 200. New clean water may be drawn from an external water source through the first water supply pipe 250 and the washing water inside the sump 200 can be drained outside through the water drain pipe 270. A first water supply valve 255 can be installed at the first water supply pipe 250 to control the supply of the water to the sump 200.

In some embodiments, at least one rack and spraying arm may be provided in the tub 110, such as inside the washing compartment 150, for example. When dishes are placed on the rack, the pump 210 pumps water and the spraying arm sprays the pumped water toward the rack. As shown, an upper rack 160 and a lower rack 170 can be disposed in an upper portion and a lower portion of the washing compartment 150, respectively. In addition, an upper spraying arm 230 and a lower spraying arm 220 can then be placed near the upper rack 160 and the lower rack 170 to spray the water pumped by the pump 210 at each respective rack. Washing compartment 150 may also include a top nozzle 240 in its upper portion to spray the water pumped by the pump 210 downward.

Dishwasher may include a steam generator 300 to supply steam to the washing compartment 150. Washing water may be circulated in the washing compartment 150 using the pump 210, and, for example, the lower spraying arm 220 and/or upper spraying arm 230. In some embodiments, steam generator 300 can be operated separately from the sump heater 290. As shown, the steam generator 300 may be in communication with the first water supply pipe 250. The steam generator 300 may be in communication with the washing compartment 150 via a steam supply pipe 280. A second water supply valve 265 may be installed at a second water supply pipe 260 to control the supply of the water to the steam generator 300.

Steam generator 300 can include a steam heater 310 for heating the water supplied to the steam generator 300 and a water level sensor 320 for sensing a water level inside the steam generator 300. The water level sensor 320 may sense a low level and a high level of water, for example. The low level can be predetermined or set to protect the steam heater 310 of the steam generator 300 and the high level can be predetermined or set to prevent the water supplied to the steam generator 300 from overflowing. In addition, the steam generator 300 may include a steam supply valve (not shown) for controlling the opening and closing of the steam supply pipe 280 so that the steam can be supplied to the washing compartment 150 at various times or intervals.

The sump 200 may include a pollution level sensor (not shown) in a predetermined portion of the sump 200, which measures a pollution level of the washing water circulated in the tub 110, for example. In an embodiment, the door 120 may include an exhaust fan 190 and an exhaust duct 192 to exhaust damp air from the washing compartment 150. In some embodiments, a control unit 102, which controls the dishwasher, may be operationally connected with the control panel 130, the pump 210, and the steam generator 300.

The controller 102 may control the dishwasher in accordance with predetermined instructions stored in a memory (not shown). The controller 102 may be operationally coupled with at least the control panel 130, the washing pump 210, and the steam generator 300 so that they may be operated in accordance with a user's selection on the control panel 130.

A variety of operational modes may be predetermined in the dishwasher. For example, an operational mode of the dishwasher may be determined based on a user's selection or a type of a dish. In addition, the operational mode may be determined based on a pollution or contamination level of a dish. Advantageously, when the operational mode(s) is determined, operating parameters, such as the number of rotations per minute of the motor or the amount of detergent can be selected based on the determined operational mode.

The method of controlling or operating the dishwasher may include performing a washing cycle (W), rinsing (R) cycle, and drying cycle. During the washing cycle (W), food scraps on the dishes can be removed. During the rinsing cycle (R), the dishes are rinsed. The rinsing cycle (R) may occur after the washing cycle (W). During the drying cycle, the moisture remaining on the dishes can be removed. In addition, smaller cycles may be performed within each of the washing, rinsing, or drying cycles and/or other cycles may be included.

With continued reference to FIG. 1, the dishwasher may include a washing compartment 150 having a bi-level rack 160 and 170 that holds dishes. In some embodiments, the upper rack 160 and the lower rack 170 can be in a bi-level configuration. In addition, the upper spraying arm 230 and the lower spraying arm 220 can be provided near the upper rack 160 and the lower rack 170 to spray washing water at each respective rack. A number of holders can be provided in the upper rack 160 to hold small dishes, such as small cups with a substantially smaller washing load, and a number of holders can be provided in the lower rack 170 to hold large dishes, such as dinner dishes or large bowls with a substantially larger washing load.

The dishwasher can also include a sump 200 configured to contain water and a plurality of spraying arms 220 and 230. The plurality of spraying arms 220 and 230 can be provided in the washing compartment 150 at different heights and spray water at the racks in alternation or alternatively, for example. A steam generator 300 can supply steam to the washing compartment 150 one or more times between the sprayings of the water during a primary period of the washing cycle (W). In addition, a pump 210 can supply varying volumes of water per unit time to the plurality of spraying arms 220 and 230. For example, the pump 210 may supply a first volume of water per unit time to spraying arm 220, and a second volume of water per unit time, less than the first, to spraying arm 230.

In some embodiments, pump 210 can supply the water to the spraying arms 220 and 230 selectively, simultaneously, or alternately. Because the pump 210 can supply different volumes of water per unit time to the spraying arms, each spraying arm may spray the dishes held on the racks at a different water pressure. When the water pressure is adjusted by the pump 210, separation of food scraps from the dishes held in the dishwasher can be improved. For example, when water pressure is increased washing efficiency may be increased because food scraps are more thoroughly soaked and easily separated from dishes by the water sprayed from the spraying arms.

The water supplied to the plurality of spraying arms can be supplied selectively or simultaneously using a conversion motor and/or valve. In an embodiment, when a conversion period of the conversion motor is in accord with a change standard time of the water supply of the pump 210, a different volume of water per unit time can be supplied to each of the spraying arms. The volume of the supplied water per unit time may be in relation to the pressure of the water sprayed from the spraying arm(s), such that the washing efficiency of the spraying arms is differentiated.

The number of revolutions per minute of a motor operating the pump 210 can be changeable to supply varying volumes of water per unit time to the spraying arms. For example, when pump 210 supplies the water to the upper spraying arm 230, the motor of the pump 210 can be controlled to rotate at 1700 rpm. In addition, when the pump 210 supplies water to the lower spraying arm 220, the motor can be controlled to rotate at 2000 rpm. Of note, the rotation speed and water pressure of the spraying arms may vary based on the volume of water supplied per unit time to each spraying arm. For example, as the water supply and the water pressure of the spraying arm increases, the rotation speed of the spraying arm may increase substantially. This may occur because, in some embodiments, the spraying arms of the dishwasher may be rotated based on the pressure of the water sprayed from openings on the spraying arms. Thus, if the water pressure (and by extension, water volume per unit time) supplied to each of the spraying arms varies, the rotation speeds of the spraying arms can vary.

Because it can be inefficient to perform a washing cycle when a washing compartment 150 includes both large dishes with a large washing load and small dishes, such as cups, with a small washing load, a different volume of water could be supplied by the pump 210 per unit time, to increase washing efficiency. A pump 210 can be used to supply varying volumes of water per unit time to the plurality of the spraying arms. Each spraying arm can spray water at a different water pressure and thereby rotate at a different speed. Advantageously, embodiments of the present disclosure can prevent small dishes from being washed for an unnecessarily long period of time and can thus reduce power consumption of the dishwasher.

Figure 2:
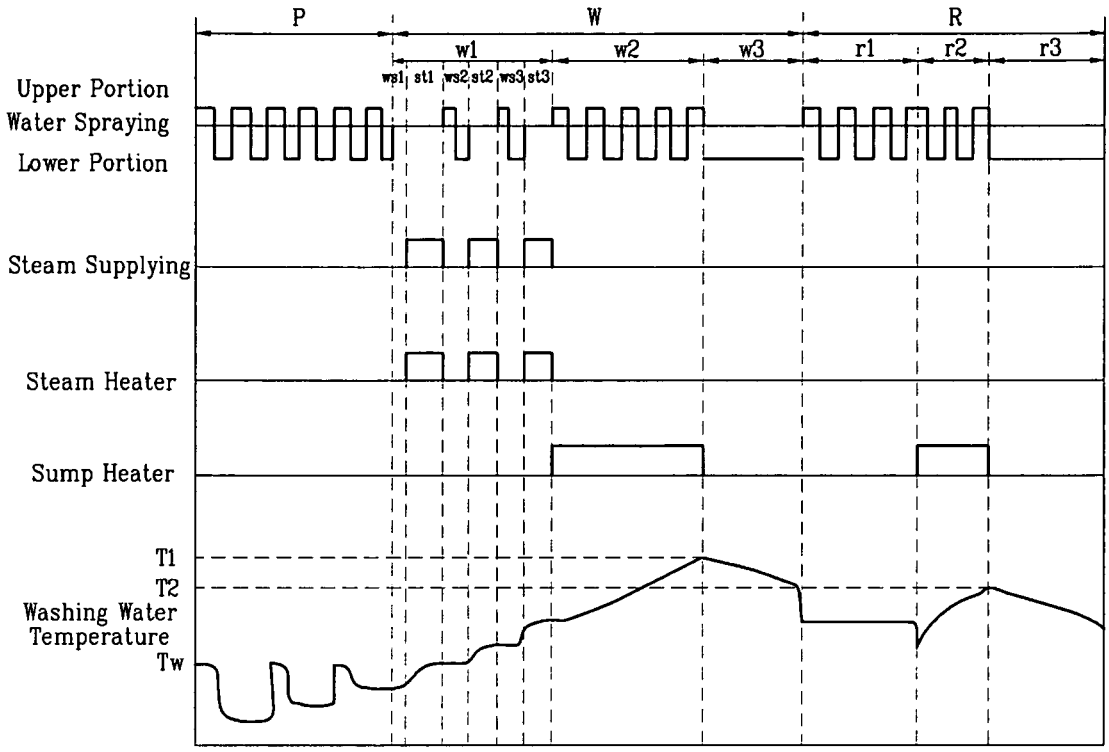
FIG. 2 illustrates overall operation of a dishwasher, according to an embodiment of the invention.

FIG. 2 illustrates overall operation of the dishwasher, according to an embodiment of the invention, including exemplary methods employed to control the operation of the dishwasher. Of note, the exemplary methods include performing a preliminary wash cycle (P), performing a main washing cycle (W), and a rinsing cycle (R).

During the preliminary washing cycle (P), the water supplied from an external water source can be sprayed on to dishes. An external water source may include a city or household water system connected to first water supply pipe 250, and may also include the sump 200. The supplied water may be cold, room temperature, or heated to a predetermined temperature to reduce the washing time. In FIG. 2, water temperature may be denoted as (Tw). The sump heater 290 may be used to heat the water. The preliminary washing cycle (P) may be used to remove primary food scraps from the dishes. Water may be supplied to the upper spraying arm 230 and the lower spraying arm 220 and sprayed alternately.

As further shown in FIG. 2, water spraying during the preliminary washing cycle (P) can include supplying water to the upper spraying arm 230 (hereinafter, "upper spraying") and supplying water to the lower spraying arm 220 (hereinafter, "lower spraying"). The water sprayed from the upper spraying arm 230 of the upper portion of the dishwasher may be sprayed toward the upper rack 160. The water sprayed from the lower spraying arm 220 of the lower portion of the dishwasher may be sprayed toward the lower rack 170. The upper and lower spraying can be repeated alternately for a preset time period. For example, the upper spraying and the lower spraying may be repeated alternately, each for a preset number of minutes. The number of minutes for each cycle of upper spraying may or may not equal the number of minutes for each cycle of lower spraying Of note, alternating between upper and lower spraying can be used during the main washing cycle (W) and the rinsing cycle (R) as described in further detail herein.

The water used during the preliminary washing cycle (P) can be supplied from an external water supply source and may be cold or warm water. Warm water can be used to enhance washing efficiency or reduce washing time. In some embodiments, when the temperature of the water supplied is between approximately 40° C. and 50° C., the warm water can be heat-exchanged with the sump 200 and the temperature of the warm water may decrease. In addition, water may be supplied during the preliminary washing cycle (P) several times. As shown, when water is supplied during the preliminary washing cycle (P), the temperature of the water increases gradually. This can occur because the water supplied during the preliminary cycle may be heat-exchanged with the sump 200 to increase the temperature of the sump 200. As a result, the variation of temperature between the supplied water and the washing water can be reduced.

With continued reference to FIG. 2, after the preliminary washing cycle (P) is completed, the main washing cycle (W) may begin. During a primary period (w1) of the main washing cycle (W), water (ws1, ws2, ws3) and steam (st1, st2, st3) can be repeatedly supplied to satisfy a preset condition. The supplying of the water (ws1, ws2, and ws3) can be used to separate or wash foreign matter from the dishes and the supplying of the steam (st1, st2, and st3) can be used to soak the foreign matter stuck on surfaces of the dishes.

In addition, a steam generator 310, which generates steam, can be turned on and the sump heater 290 may be turned off during the supplying of the steam (st1, st2, st3). This can reduce electrical overload, or reduce the amount of power drawn by the dishwasher, when operating the steam generator 300 and the sump heater 290.

Of note, during the primary period (w1) of the main washing cycle water supplying can occur in intervals or stages (ws1, ws2, ws3) and steam supplying can occur in intervals or stages (st1, st2, st3) repeatedly until a preset condition, such as temperature of water in the sump, is satisfied. Because of the steam supplying, the temperature of the washing water can increase gradually (and without operation of the sump heater 290).

Although the water supplying (ws1, ws2, ws3) and the steam supplying (st1, st2, and st3) are depicted as being performed three times in the primary period (w1) of the main washing cycle (W), the number of times and period in which they occur is not limited thereto. For example, the number of occurrences of water supplying may be variable based on the alternation between upper and lower spraying. In addition, the supplying of the steam can be repeated several times during the primary period (w1) of the main washing cycle (W) to make the temperature of the washing water increase gradually. Also, as shown in FIG. 2 in an exemplary and non-limiting fashion, the upper spraying included in the supplying of the water may be performed one time and the lower spraying may be performed one time between the supplying of the steam period (st1, st2, st3). However, it should be appreciated that the number of times may vary even further.

In an embodiment, when a preset condition is satisfied in the primary period (w1) of the washing cycle (W), period (w2) and (w3) may begin. During period (w2) alternate repeating of upper and lower spraying can be performed by the upper spraying arm 230 and the lower spraying arm 220. Water can be sprayed by the upper spraying arm 230 and the lower spraying arm 220 alternately and for any number of repetitions. Of note, when the sump heater 290 is not in operation, the temperature of the washing water used in the washing cycle (W) may decrease gradually.

During period (w2) alternate repeating of upper and lower spraying can be performed by the upper spraying arm 230 and the lower spraying arm 230. In addition during period (w2), the sump heater 290 can be turned on to heat the washing water. When the sump heater 290 is on and a preset first condition is satisfied, period (w2) may stop. The preset first condition may be, for example, a temperature reached by water contained in the sump 200, a temperature which water heated by the sump heater 290 exceeds, or a time period during which upper and lower spraying occurs. When the preset condition is satisfied during period (w2), period (w3) may begin.

During period (w3) the upper spraying may stop, and spraying the water using only the lower spraying arm 220 can occur. In the lower spraying of period (w3), the water may be sprayed intensively to the lower rack 170, which may hold large dishes with a substantially large washing load, so the large dishes can be washed one more time. As shown, the lower spraying generally begins when the temperature of the water used in the washing cycle reaches the preset first temperature (T1). The first temperature (T1) may be in a range between approximately 67° C. and 73° C. In some embodiments, when the washing water reaches the first temperature (T1) the dishes on the upper rack, such as those having a substantially smaller washing load, are adequately washed.

Sump heater 290 may be turned off during the lower spraying of period (w3). The lower spraying during period (w3) can be performed without additional heating because the washing water may already be sufficiently heated. In addition, the lower spraying of period (w3) can be repeated for a preset time period during which the upper spraying arm 230 may not spray washing water.

Advantageously, the washing cycle (W) can prevent excessive washing of the dishes on the upper rack 160. In addition, to wash multiple areas having different washing loads efficiently, it may be predetermined to wash one or more of the areas having substantially larger washing loads additionally, if the above preset condition is satisfied. A skilled artisan will recognize that small dishes may be held on the upper rack 160 and thus embodiments of the present disclosure may include using a lower spraying arm 220 to perform extra spraying of the lower rack 170. Alternatively, the upper spraying arm 230 may perform additional spraying when the upper rack 160 hold dishes with a substantially larger washing load, for example during period (w3). In some embodiments, a washing mode can be selected based on the size of the washing loads of the upper rack 160 and/or the lower rack 170. As a result, additional upper or lower spraying can be performed based on the selection of the washing mode.

After the lower spraying occurs during period (w3) of the washing cycle (W), the washing water can be drained and/or new clean water can be supplied (hereinafter, "draining and supplying"). When the draining and supplying finishes, the rinsing cycle (R) which sprays the newly supplied water may begin.

With continued reference to FIG. 2, the rinsing cycle (R) can generally include several processes or sub-cycles. During the rinsing cycle (R), the draining and supplying of water may be repeated one or more times. By way of example only, the rinsing cycle (R) can include spraying water using the upper spraying arm 230 and the lower spraying arm 220 alternately when the sump heater 290 is in a turned off state (hereinafter, "first alternative upper/lower spraying (r1)") during period (r1). In addition, the rinsing cycle (R) can also include spraying water using the upper spraying arm 230 and the lower spraying arm 220 when the sump heater 290 is in a turned on state (hereinafter, "second alternate upper/lower spraying (r2)") during period (r2). Rinsing cycle (R) can also include spraying water using just the lower spraying arm 220 when the sump heater 290 is in a turned off state (hereinafter, "lower spraying (r3)") during period (r3). During period (r3), additional lower spraying can be performed without sump heater 290 heating the water because the rinsing water may be adequately heated when period (r3) occurs.

In an embodiment, the water used during the first alternate upper/lower spraying of primary period (r1) of the rinsing cycle (R) may not be the same water used during the other periods (r2) and (r3). For example, the water used during period (r1) can be drained and new water supplied. In addition, the second alternate upper/lower spraying with the sump heater 290 on which occurs during period (r2) and the lower spraying which occurs during period (r3), can be performed in an order similar to that of washing cycle (W).

The subdividing of the rinsing cycle (R) can remove remaining matter on the dishes more efficiently, and based on the washing load. For example, the lower spraying of period (r3) which sprays rinsing water using only the lower spraying arm 220 can be selectively performed if a preset condition is satisfied. In an embodiment, the preset condition may be satisfied when sump heater 290 is in a turned on state. The preset condition may be, for example, an operation time of the second alternate upper/lower spraying of period (r2) or a temperature that the rinsing water reaches.

As shown in FIG. 2, the lower spraying of period (r3) begins when the temperature of the rinsing water reaches a preset second temperature (T2). The second temperature (T2) can generally indicate that the dishes held on the upper rack 160 with a substantially smaller washing load are sufficiently washed and/or rinsed. In one embodiment, the second temperature (T2) may be in a range between approximately 63° C. and 67° C. Of note, the second temperature (T2) can be lower than the first temperature (T1) discussed above with respect to controls for the washing cycle (W).

Figure 3:
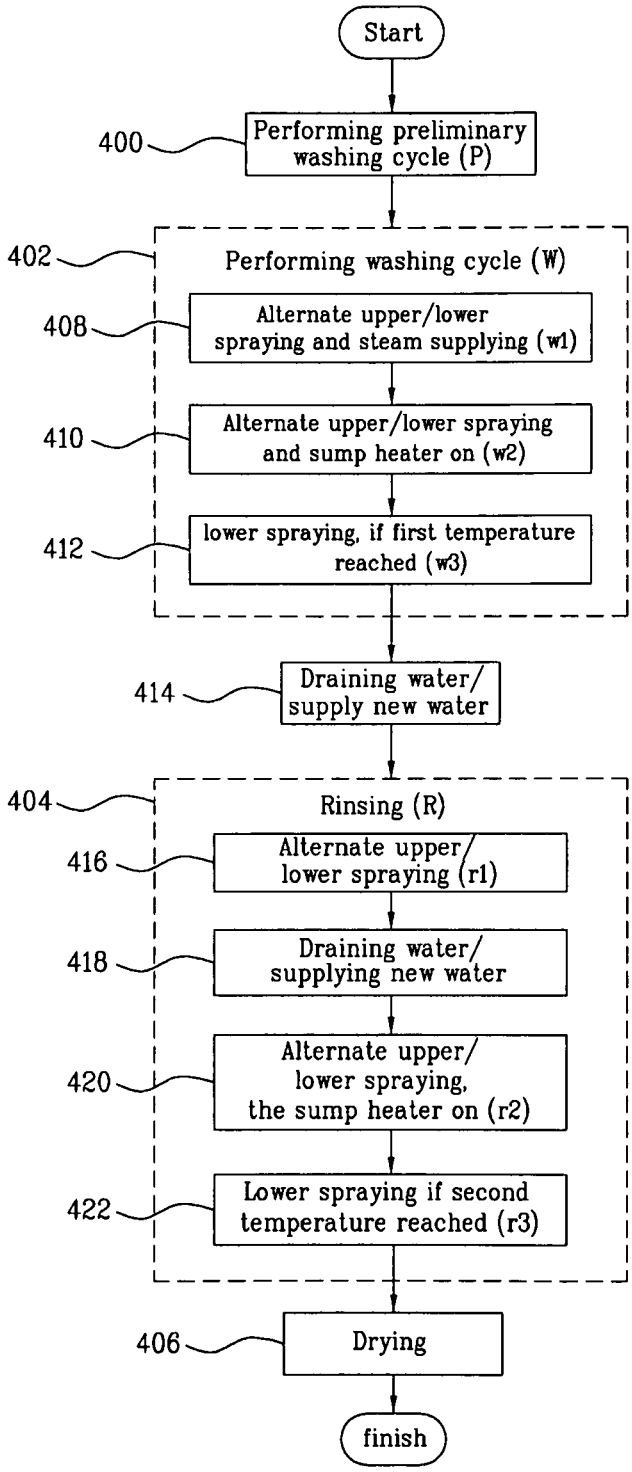
FIG. 3 illustrates an exemplary method that may be employed to control the dishwasher of FIG. 1, according to an embodiment of the invention.

FIG. 3 illustrates an exemplary method that may be employed to control the dishwasher of FIG. 1, according to an embodiment of the invention. Embodiments of the exemplary method can advantageously allow dishes with varying washing loads stored in different areas of the dishwasher to be washed efficiently. As shown, the methods can include performing a preliminary washing cycle (P) 400, a main washing cycle (W) 402, and a rinsing cycle (R) 404. In addition, the method may include a drying cycle 406 in which the dishes contained in the washing compartment 150 can be dried.

The performing of the washing cycle (W) 402 can include period (w1) 408 in which the upper spraying arm 230 and the lower spraying arm 220 spray water in alternation (depicted as "alternative upper/lower spraying") and steam may be supplied at predetermined timings for a preset period. During the alternative upper and lower spraying, water may be sprayed sequentially by the upper 230 and lower 220 spraying arms.

In period (w2) 410 of the washing cycle (W) 402, upper and lower spraying can occur repeatedly while the sump heater 290 is turned on. In period (w3) 412 of the washing cycle (W) 402, when the temperature of the washing water, as measured for example by the temperature of water in the sump 200, reaches a preset first temperature, water can be sprayed using only the lower spraying arm 220. After the washing cycle (W) 402 is performed, then at 414 the washing water can be drained and new water supplied to the dishwasher.

Continuing to the rinsing cycle (R) 404, during period (r1) 416 the upper spraying arm 230 and the lower spraying arm 220 spray water in alternation. Next, at 418, the rinsing water may be drained and new water supplied. In period (r2) 420 of the rinsing cycle (R) 404, upper and lower spraying can occur in alternation while the sump heater 290 is turned on. In period (r3) 422 of the rinsing cycle (R) 404, when the temperature of the rinsing water reaches a preset second temperature (T2), water can be sprayed using only the lower spraying arm 220.

It will be apparent to those skilled in the art that various modifications and variations can be made in the present disclosure without departing from the spirit or scope of the disclosure. Thus, it is intended that the present disclosure cover any modifications and variations within the scope of the appended claims and their equivalents.

What is claimed is:

1. A controlling method of a dishwasher comprising a washing compartment, a sump configured to contain water, a steam generator configured to supply steam to the washing compartment, a sump heater configured to heat the water in the sump, an upper rack holding dishes with a smaller washing load and a lower rack holding dishes with a larger washing load, an upper and a lower spraying arm configured to spray washing water toward the upper rack and the lower rack, respectively, the method comprising:

performing a washing cycle comprising:

supplying steam to the washing compartment, and spraying water to the upper rack and the lower rack alternately by using the upper spraying arm and the lower spraying arm, each spraying arm spraying water at a different water pressure and thereby rotating at a different speed, the supplying steam and the spraying water being repeated alternately for a preset period; and rinsing by spraying water toward the upper rack and the lower rack alternately, wherein the performing of the washing cycle further comprises spraying the water by only using the lower spraying arm to additionally and intensively wash an area having a larger washing load if the washing cycle reaches a preset first condition with the sump heater being on, wherein the rinsing is performed in a state of the sump heater being on, and the rinsing comprises spraying the water by using only the lower spraying arm if a preset second condition is reached during the rinsing, wherein the preset first condition is a first temperature of the water contained in the sump and the preset second condition is a second temperature of the water contained in the sump lower than the first temperature, wherein the steam generator is turned on and the sump heater is turned off during the supplying steam, and wherein the spraying the water by only using the lower spraying arm is repeated for a preset time period during which the upper spraying arm does not spray washing water.

2. The controlling method of claim 1, wherein the first temperature is between 67° C. and 73° C.

3. The controlling method of claim 1, wherein the second temperature is between 63° C. and 67° C.

4. The controlling method of claim 1, further comprising:

at least one of draining the washing water from the sump and supplying new water to the sump before the rinsing and drying after the rinsing.

5. The controlling method of claim 1, wherein the supplying steam is performed more than three times.

6. A controlling method of a dishwasher comprising a washing compartment, a steam generator configured to supply steam to the washing compartment, a sump configured to contain water, an upper rack holding dishes and a lower rack holding dishes, an upper and a lower spraying arms configured to spray the water from the sump toward the upper rack with a smaller washing load and the lower rack with a larger washing load, respectively, the controlling method comprising:

performing a washing cycle comprising:

supplying steam to the washing compartment, spraying different volumes of water per unit time by using the upper and lower spraying arms alternately so that each spraying arm sprays water at a different water pressure and thereby rotates at a different speed, rinsing by spraying water by using the upper and the lower spraying arms alternately in a state of the sump heater being on, and wherein the supplying steam and the spraying water at the different volumes per unit time are repeated alternately for a preset period in the performing of the washing cycle; and draining the water used in the performing of the washing cycle from the sump and supplying new water to the sump, wherein the performing of the washing cycle further comprises spraying the water by only using the lower spraying arm to additionally and intensively wash an area having a larger washing load if the water contained in the sump reaches a first temperature with the sump heater being on, wherein the rinsing is performed in a state of the sump heater being on, and the rinsing comprises spraying the water by using only the lower spraying arm if the water contained in the sump reaches a second temperature lower than the first temperature, wherein the steam generator is turned on and the sump heater is turned off during the supplying steam, and wherein the spraying the water by only using the lower spraying arm is repeated for a preset time period during which the upper spraying arm does not spray washing water.

7. The controlling method of claim 6, wherein the water volume of the upper spraying arm per unit time is smaller than the water volume of the lower spraying arm per unit time.

8. The controlling method of claim 6, wherein the first temperature is between 67° C. and 73° C.

9. The controlling method of claim 6, wherein the second temperature is between 63° C. and 67° C.

* * * * *